US007134950B2

(12) United States Patent
Lamers

(10) Patent No.: US 7,134,950 B2
(45) Date of Patent: Nov. 14, 2006

(54) CENTER CLAMP

(75) Inventor: Norbert Lamers, Moers (DE)

(73) Assignee: Wendt GmbH, Meerbusch (DE)

( * ) Notice: Subject to any disclaimer, the term of this patent is extended or adjusted under 35 U.S.C. 154(b) by 0 days.

(21) Appl. No.: 11/090,945

(22) Filed: Mar. 25, 2005

(65) Prior Publication Data

US 2005/0215187 A1 Sep. 29, 2005

(30) Foreign Application Priority Data

Mar. 25, 2004 (EP) ..... 04007178

(51) Int. Cl.
*B24B 41/06* (2006.01)
*B25B 1/10* (2006.01)

(52) U.S. Cl. ..... 451/365; 451/364; 451/367; 451/385; 269/249; 269/274; 269/275; 269/45

(58) Field of Classification Search ..... 451/364, 451/365, 367, 385; 269/249, 274, 275, 45
See application file for complete search history.

(56) References Cited

U.S. PATENT DOCUMENTS 4,770,401 A * 9/1988 Donaldson ..... 269/249
6,431,534 B1 * 8/2002 Orosz et al. ..... 269/43

FOREIGN PATENT DOCUMENTS

| | | |
|---|---|---|
| DE | 4301214 | 8/1993 |
| EP | 1291131 | 3/2003 |

* cited by examiner

*Primary Examiner*—Joseph J. Hail, III
*Assistant Examiner*—Shantese McDonald
(74) *Attorney, Agent, or Firm*—Andrew Wilford

(57) ABSTRACT

A center clamp used with a machining tool having an annular edge has a C-shaped body having an inner end inside the edge and an outer end outside the edge and spaced from it along a clamp axis. A push rod extends along the axis through the outer body end. A rotary joint centered on the axis has an inner part on the inner body end and an outer part rotatable on the inner part about the axis. An axial actuator relatively axially shifts the body and the push rod and thereby clamps a workpiece between an end face of the rod and the outer part of the joint. An angular actuator pivots the push rod about the axis and thereby, when the workpiece is clamped between the rod and the joint, pivots the workpiece about the axis.

13 Claims, 5 Drawing Sheets

Fig. 1
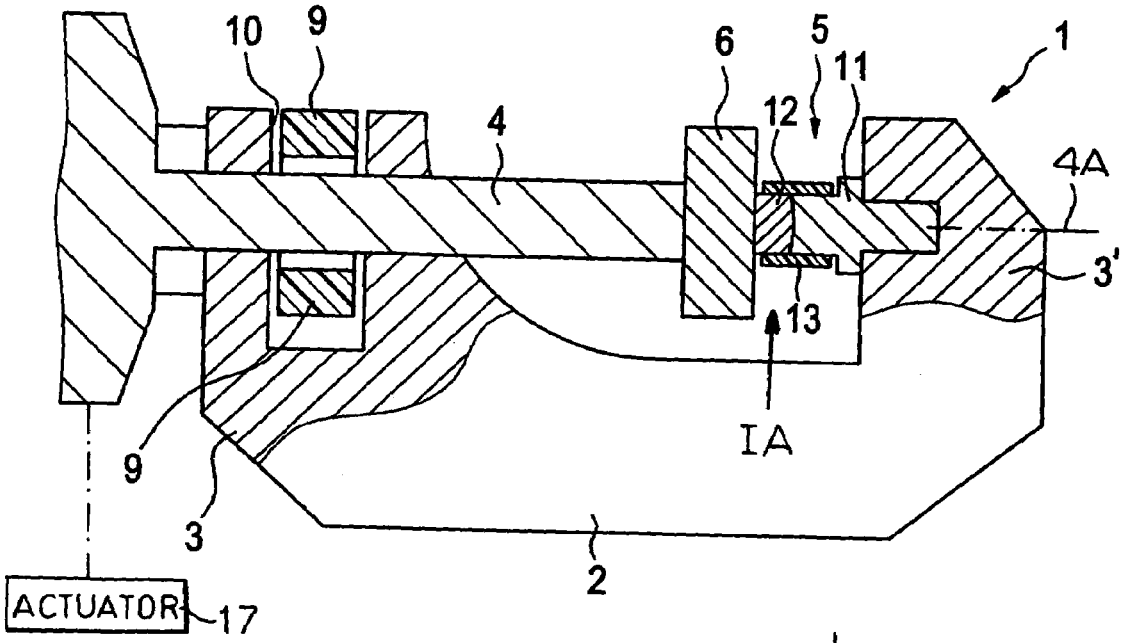
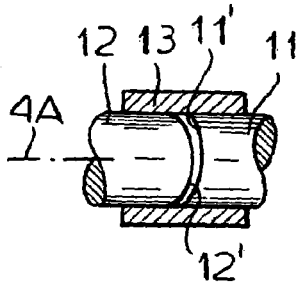
Fig. 1A
Fig. 2
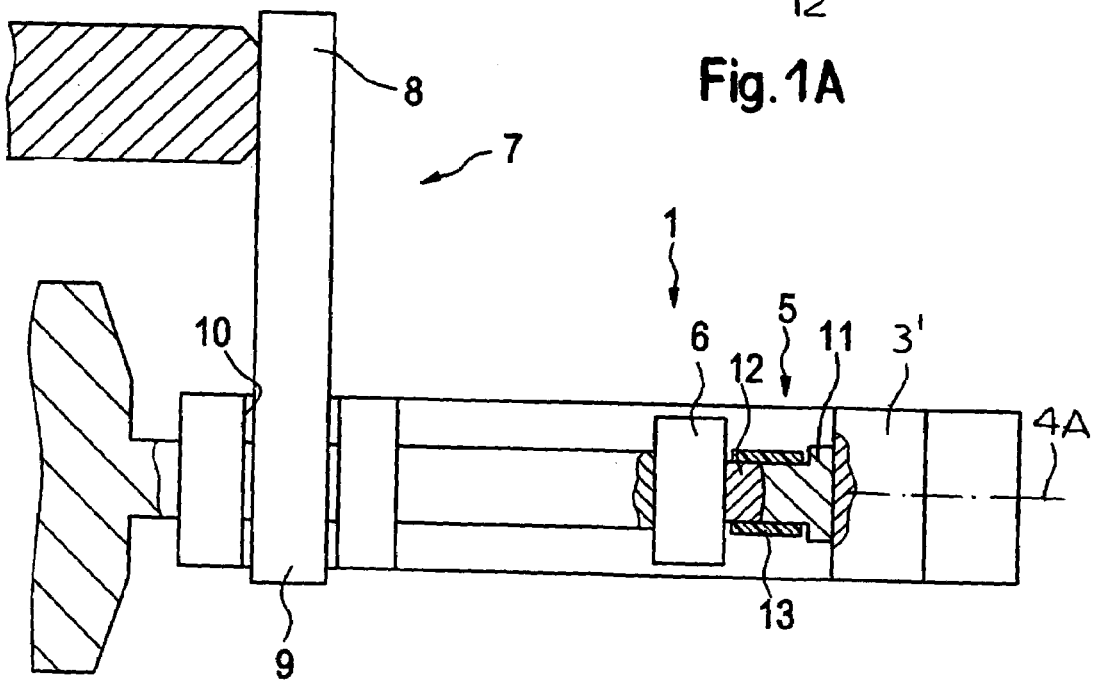

CENTER CLAMP

FIELD OF THE INVENTION

The present invention relates to a center clamp. More particularly this invention concerns such a clamp used when grinding a workpiece with a cup wheel.

BRIEF DESCRIPTION OF THE DRAWING

In the accompanying drawing:

FIG. 1 is a partly diagrammatic and sectional side view of a center clamp according to the invention;

FIG. 1A is a large-scale view of the detail indicated at IA in FIG. 1;

FIG. 2 is a top view of the structure of FIG. 1;

BACKGROUND OF THE INVENTION

Figure 3:
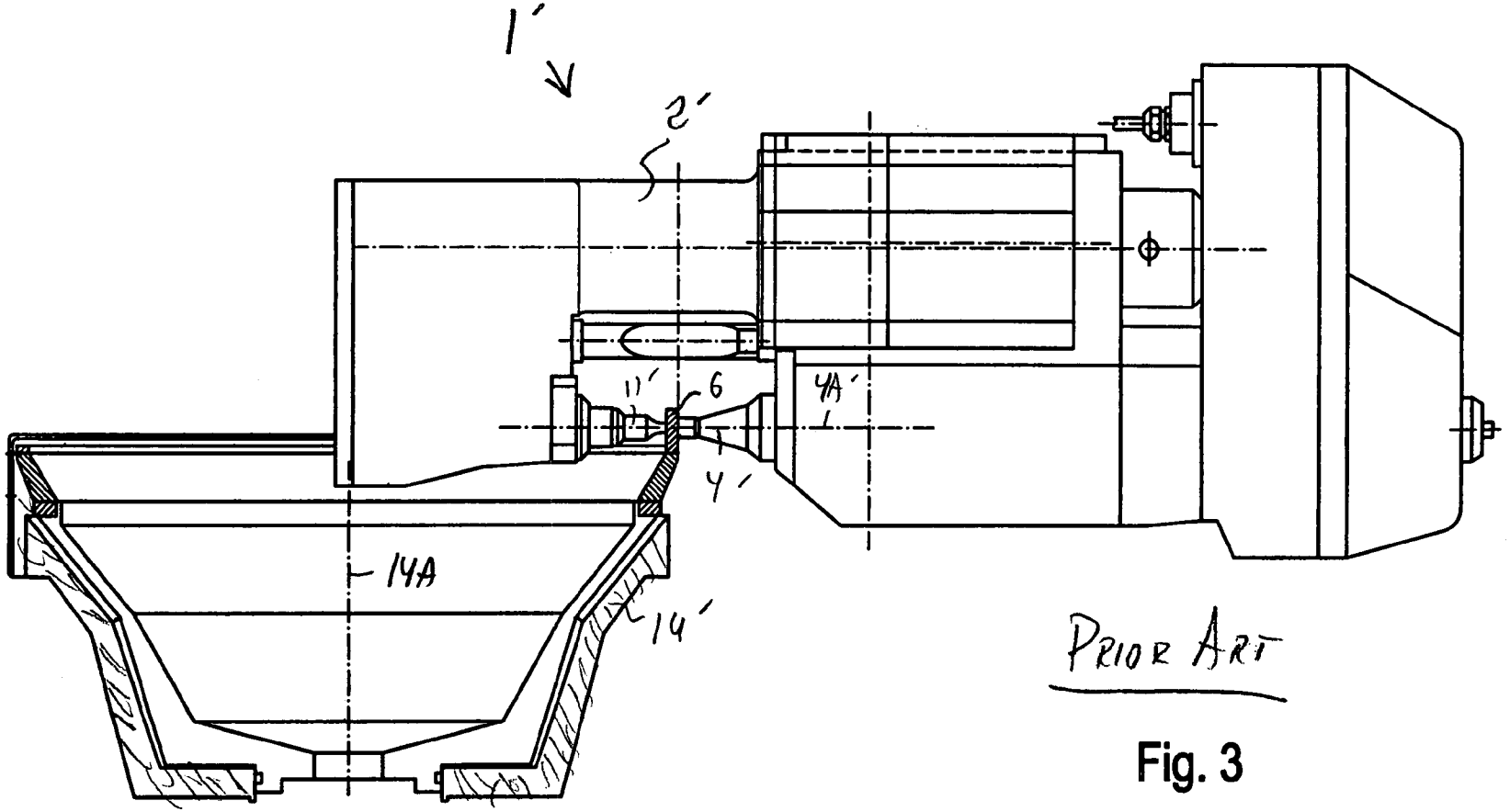
PRIOR ART Fig. 3
FIG. 3 is a prior-art clamp.

A standard center clamp 1' as shown in FIG. 3 holds a workpiece 6 to be machined between two rods 4' and 11' so that the center clamp 1' is an expensive and fairly tall device. Both the torque for angularly orienting the gripped workpiece 6 as well as the clamping force are the responsibility of respective drives at the outer end of the center clamp, that is outside a cup wheel 14', while the gripping force passes parallel to an axis 4A' through a force-transmitting element 2' to the inner end and is there applied by a rocker arrangement to avoid deformations of the center clamp 1' from the gripping force being exerted.

The disadvantage with this system is that such known center clamps are only limitedly pivotal as a result of their large size. Furthermore, they cannot normally be swung down into a standard cup wheel since the available space is relatively limited and the center clamp must not touch the edge of the cup wheel.

Hence when all the edges of the workpiece must be machined it is necessary that such center clamps be made axially relatively long in order that the necessary machining can take place on the far side of the grinding wheel, since there the required pivoting is possible without the possibility of contact. As a result of the long travel, machining with such a clamp is relatively slow and the long axial reach reduces the stiffness of the machining system, leading to sloppier machining results.

OBJECTS OF THE INVENTION

It is therefore an object of the present invention to provide an improved center clamp.

Another object is the provision of such an improved center clamp that overcomes the above-given disadvantages, in particular that is which allows a workpiece to be rotated about an axis as it is being machined by, for instance, a cup-type grinding wheel.

SUMMARY OF THE INVENTION

A center clamp used with a machining tool having an annular machining edge has according to the invention a C-shaped body having an inner body end inside the machining edge and an outer body end outside the machining edge and spaced along a clamp axis extending generally radially across the edge from the inner end. The machining tool normally is rotated about a vertical axis on which its annular edge is centered and that perpendicularly intersects the clamp axis. A push rod extends along the clamp axis through the outer body end. A rotary joint centered on the axis has an inner part on the inner body end and an outer part between the inner part and the push rod and rotatable on the inner part about the axis. An axial actuator relatively axially shifts the body and the push rod and thereby clamps a workpiece between an inner end face of the rod and an outer face of the outer part of the joint. An angular actuator pivots the push rod about the axis and thereby, when the workpiece is clamped between the rod and the joint, pivots the workpiece about the axis. In practice means is actually provided to inhibit rotation of the clamp body about the push-rod axis.

According to the invention the center clamp is made small compared to the cup wheel, having a body length of about 6 to 10 cm, in particular about 8 cm.

The gripped workpiece according to the invention can be pivoted about the rod axis into virtually any position relative to the grinding wheel, that is through 360°, without any contact between the grinding wheel and the clamp, as the C-shaped body remains stationary even as the workpiece is turned. As a result virtually any location on the workpiece gripped by the center clamp can be machined without having to shift the center clamp over a long axial distance relative to the grinding wheel. Furthermore, force transmission is moment-free, so that no stiffening parts or expensive guides are needed.

The stability and stiffness of the entire device is increased, thereby producing better machining results and reducing machining time. As a result of the relatively short height substantial stiffness is obtained with much less actual structure so that the cost of such a device is substantially reduced.

In accordance with the invention one of the joint parts has a concave face and the other of the parts has a generally complementary convex face fitted with the concave face, both faces being centered on the clamp axis. Furthermore the faces are part-spherical. The face of the outer part has a radius or curvature that is slightly less, e.g. up to 100 μm, than a radius of curvature of the inner part, so that they bear on each other at the axis in what is virtually point contact. In addition the outer part can be tapered toward the rod and a flexible sleeve surrounds the two parts and holds same axially together. Finally, the inner part can be harder than the outer part, made of hardened steel while the outer part can be of mild steel, so that wear is mainly restricted to this easy-to-replace outer part. The harder part can also be made of a material such as ceramic, tungsten carbide, or the like. It is also possible for the support part to be made cylindrical or frustoconical with a correspondingly curved outer end face.

According to a feature of the invention, the axial actuator axially shifts the body and holds the push rod stationary. In addition the angular actuator is connected to the push rod. The body is formed with a groove in which the forked end of the lever fits so the lever is axially coupled to the body. The angular actuator is coupled only to the rod.

In another system according to the invention the axial actuator axially shifts the push rod and holds the body stationary.

In a preferred embodiment the diameter of the push rod is very small, in particular only a few millimeters, so that even a relatively small workpiece, e.g. cutting plates with an inside periphery of only a few millimeters, can be machined without problems.

The axial and angular actuators lie wholly outside the annular tool edge. Furthermore the push rod has an end face engageable with the workpiece and can be formed with a central cutout defining an annular edge that is engageable with the workpiece. The center cutout that improves centering action. In addition the annular contact region between the rod and the workpiece and between the workpiece and the outer joint part is substantially greater than the contact region between the outer joint part and the inner joint part, so that, all else being equal, rotation of the push rod will rotationally entrain the workpiece and outer joint part. There will be slip between the outer joint part and the inner joint part as the push rod rotates the workpiece. The amount of friction is, of course, a function of the materials of the workpiece and the rod and outer joint part engaging it, as well as of the contact regions, the distances from the push-rod axis, and all the standard factors normally affecting friction. It is merely essential according to the invention that there be no slip at the workpiece, that instead the slip be confined to the joint.

SPECIFIC DESCRIPTION

Figure 4:
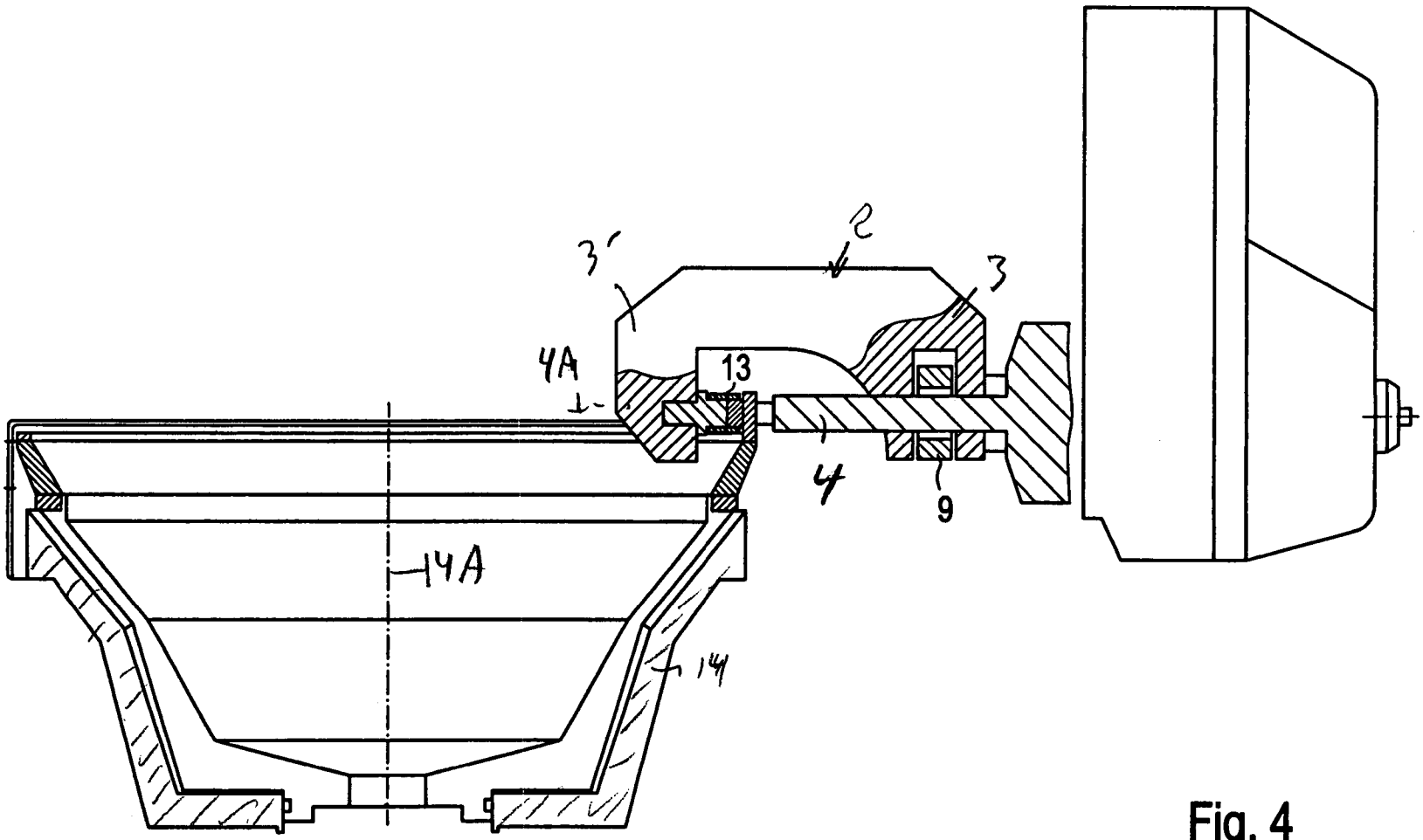
FIGS. 4 and 5 are schematic illustrations of the clamp according to the invention.

As seen in FIGS. 1 and 2 a center clamp 1 for a workpiece 6 has a generally C-shaped body 2 having an outer end 3 and an inner 3' offset laterally in the same direction, parallel to a center axis 4A of the clamp 1. The outer end 3 is normally positioned outside a cup wheel 14 such as shown in FIG. 4 which is rotated about a vertical axis 14A normally perpendicular to and intersecting the axis 4A, although of course other orientations relative to the horizontal and vertical are perfectly possible. The terms "inner" and "outer" relate to the position relative to the cup wheel 14, those being closer to its axis 14A being "inner" parts and those being further from the axis 14A being "outer" parts.

In this regard, it is noted that the system would work also if the ends 3 and 3' were inverted, that is if the entire assembly except for the tool 14 were pivoted through 180° about an axis perpendicular to the plane of the view in FIG. 4 or parallel to but offset from the axis 14A.

A push rod 4 projects along the clamp axis 4A through the outer end 3 of the clamp body 2 and is mounted so that it cannot move parallel to the axis 4A, but can rotate at least limitedly about this axis 4A relative to the body 2. The inner end 3' is provided with a rotary joint 5 that supports a workpiece 6 that is therefore pressed inward by the push rod 4 and outward by the inner end 3' that can be shifted axially to axially grip the workpiece 6. Thus, while the push rod 4 is normally axially stationary, the clamp body 2 can be forcibly moved axially relative to the push rod 4 as described in more detail below. This push rod 4 has as shown in FIG. 7 an inwardly directed end face 18 formed with a center cutout so that it engages the workpiece 6 with an annular edge centered on the axis 4A.

Figure 6:
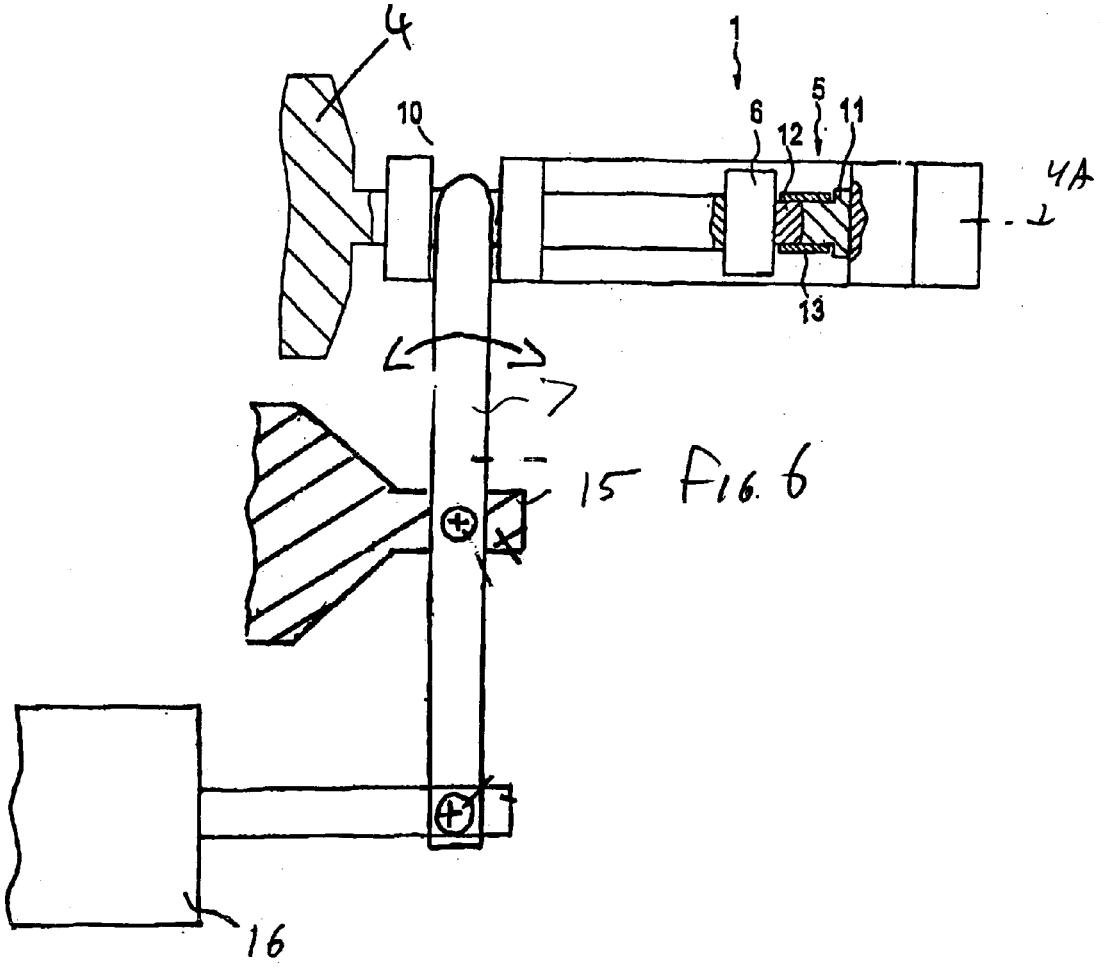
FIG. 6 is a view like FIG. 1 of an alternative arrangement in accordance with the invention.

As shown in FIG. 2 an axial actuator 7 has a fork-shaped lever 8 with two projecting lateral ends 9 that engage corresponding faces of a groove 10 on the outer end 3 of the body 2 for axial shifting of the body 2 along the axis 4A. Thus the actuator 7 serves to axially shift the clamp body 2 and axially adjust the amount the clamp 1 is opened to allow fitting-in and taking-out of the workpiece 6. It would be possible for the kinematics to be reversed, with the body 2 stationary and the rod 4 axially shiftable, but the illustrated system is preferred. This lever 8 can be mounted as shown in FIG. 6 on a pivot 15 between its ends so that a pneumatic cylinder 16 can push the lever end to pull the body 2 in and clamp the workpiece 6 and can pull it back to shift the body 2 and release the workpiece 6.

Figure 7:
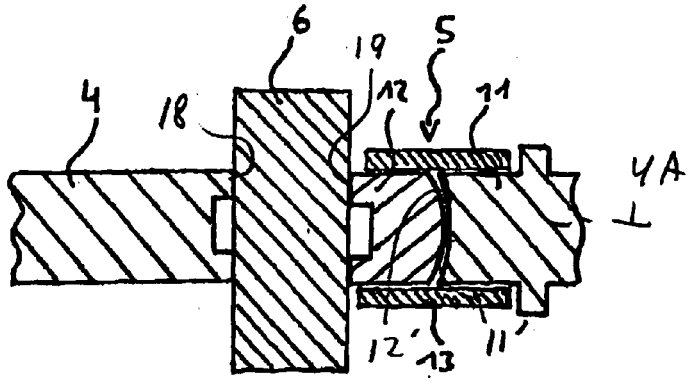
FIG. 7 is a large-scale view of a detail of FIG. 1.

The rotary joint 5, which is best seen in FIG. 7, has a generally rotation-symmetrical concave inner seat part 11 and, sitting on and coacting with it, a generally rotation-symmetrical convex outer support part 12, both oriented so that the centers of part-spherical faces 11' and 12' of the parts 11 and 12 lie on the axis 4A. A sleeve 13 that can be constituted as a shrink tube prevents unintentional disconnection of the support part 12 when no workpiece 6 is clamped between it and the end of the rod 4, and also makes it easy to replace the outer part 12. The outer part 12 can be tapered toward the rod 4 so that it is safely held by the sleeve 13.

As shown in FIG. 1A. the radius of curvature of the outer-part inner face 12' is smaller than the face 11' of the part 11, so that the parts 11 and 12 bear on each other in point contact or over a very small region on the axis 4A. In addition the inner part 11 can be harder than the outer part 12 so that wear is restricted to this easily replaced outer part 12. Furthermore as shown in FIG. 7, the outer part 12 has an outer face 19 that is centrally cutout, that is annular, like the face 18 of the rod 4. As discussed above, the goal here is to prevent slip between the workpiece 6 on one side and the push-rod face 18 on one side the outer part face 19 on the other, with all relative rotation and slip being between the faces 11' and 12'.

The push rod 4 is rotated to angularly align the workpiece 6 by means of an actuator shown schematically at 17. When the end of the push rod 4 is pressed against the outer face of the workpiece 6, whose inner face bears via the rotary coupling 5 in the inner body end 3', rotation of the push rod 4 about the axis 4A will also rotate the workpiece 6 and, with it, the outer part 12 of the coupling 5. The contact area between the workpiece 6 and the face 18 of the rod 4 is substantially greater than the contact area between the faces 11' and 12', so that the rod 4 will angularly entrain the workpiece 6 and outer part 12, with the body 2 and inner part 11 not pivoting. It would be possible to achieve a similar effect if the radius of curvature of the face 11' was smaller than that of the face 12', so that the parts 11 engaged each other at an annular contact zone, so long as the contact area were smaller than that between the outer face of the workpiece and the push-rod end edge 18.

Figure 5:
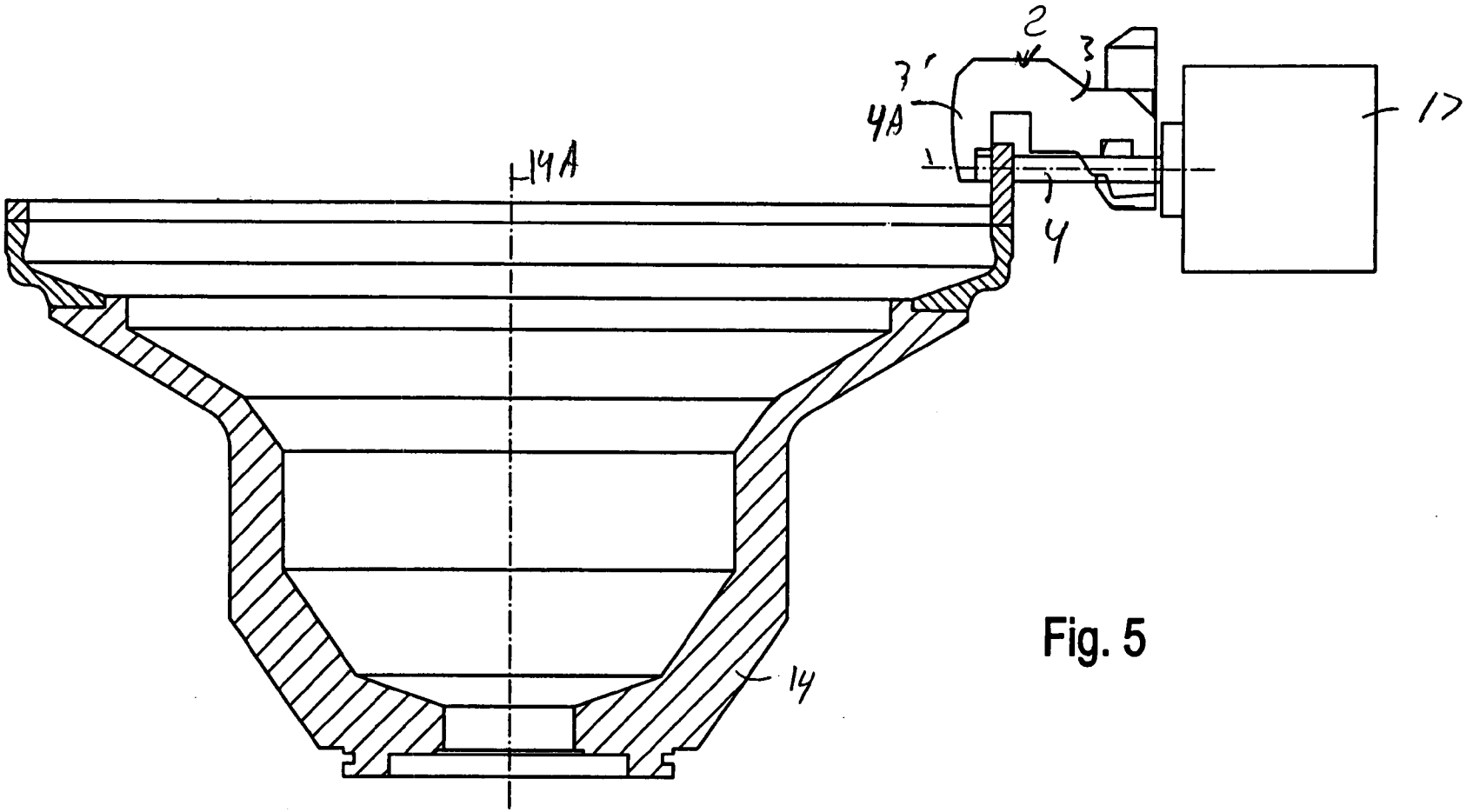

FIGS. 3, 4, and 5 show how much smaller a clamp 1 according to the invention (FIGS. 4 and 5) is than a prior-art clamp (FIG. 3).

I claim:

1. In combination with a machining tool having an annular machining edge, a center clamp comprising:

a C-shaped body having an inner body end inside the machining edge and an outer body end outside the machining edge and spaced along an axis extending across the machining edge;

a push rod extending along the axis through the outer body end and having an end face outside the machining edge;

a rotary joint centered on the axis and having inside the machining edge an inner part on the inner body end and an outer part on the inner part between the inner part and the push rod and rotatable on the inner part about the axis;

axial actuating means for relatively axially shifting the body and the push rod and thereby clamping a workpiece between the end face of the rod and the outer part of the joint; and angular actuating means for pivoting the push rod about the axis and thereby, when the workpiece is clamped between the rod and the joint, pivoting the workpiece about the axis.

2. The center clamp defined in claim 1 wherein one of the inner and outer parts has a concave face and the other of the inner and outer parts has a generally complementary convex face fitted with the concave face, both faces being centered on the axis.

3. The center clamp defined in claim 2 wherein the faces are part-spherical.

4. The center clamp defined in claim 3 wherein the face of the outer part has a radius or curvature that is slightly less than a radius of curvature of the face of the inner part.

5. The center clamp defined in claim 2 wherein the outer part is cupped and concave toward the rod.

6. The center clamp defined in claim 5 wherein the joint further comprises a flexible sleeve surrounding the inner and outer parts and holding same axially together.

7. The center clamp defined in claim 2 wherein the inner part is harder than the outer part.

8. The center clamp defined in claim 1 wherein the axial actuating means axially shifts the body and holds the push rod stationary.

9. The center clamp defined in claim 8 wherein the axial actuating means includes a lever projecting radially from and coupled to the body.

10. The center clamp defined in claim 9 wherein the lever is centrally pivoted and has a forked end fitting in a groove of the body and around the push rod and an opposite end, the axial actuating means including an actuator connected to the opposite end.

11. The center clamp defined in claim 1 wherein the axial and angular actuating means lie wholly outside the machining edge.

12. The center clamp defined in claim 1 wherein the push rod has an end face engageable with the workpiece and formed with a central cutout defining an annular edge that is engageable with the workpiece.

13. The center clamp defined in claim 1 wherein the outer joint part has an outer end face engageable with the workpiece and formed with a central cutout defining an annular edge that is engageable with the workpiece.

* * * * *